US008220633B2

(12) United States Patent
Weideman

(10) Patent No.: US 8,220,633 B2
(45) Date of Patent: Jul. 17, 2012

(54) STACKING CARTON USING A ONE-PIECE BLANK

(75) Inventor: Phil W. Weideman, Fresno, CA (US)

(73) Assignee: Georgia-Pacific Corrugated LLC, Atlanta, GA (US)

( * ) Notice: Subject to any disclaimer, the term of this patent is extended or adjusted under 35 U.S.C. 154(b) by 270 days.

(21) Appl. No.: 12/328,970

(22) Filed: Dec. 5, 2008

(65) Prior Publication Data

US 2010/0032334 A1 Feb. 11, 2010

Related U.S. Application Data

(60) Provisional application No. 61/087,925, filed on Aug. 11, 2008.

(51) Int. Cl.
*B65D 5/22* (2006.01)

(52) U.S. Cl. ..... 206/503; 206/509; 229/165; 229/174; 229/178; 229/918; 229/190

(58) Field of Classification Search ..... 229/165, 229/174, 509, 164, 178, 918, 190; 206/509, 206/503
See application file for complete search history.

(56) References Cited

U.S. PATENT DOCUMENTS 2,163,117 A * 6/1939 Wil Evans et al. ..... 229/164
3,114,493 A * 12/1963 Dunkin ..... 206/511
3,940,053 A 2/1976 Putman et al.
4,134,533 A * 1/1979 Heavner ..... 206/509
4,244,507 A * 1/1981 Garmon ..... 229/143
5,295,631 A * 3/1994 McClure ..... 229/150
5,501,395 A * 3/1996 McElroy ..... 229/148
5,860,590 A 1/1999 Blomfield et al.
6,158,652 A 12/2000 Ruiz et al.
6,296,178 B1 10/2001 McKenna, Sr.
6,641,032 B1 * 11/2003 Schilling ..... 229/174
7,922,069 B2 4/2011 Gardner
8,070,053 B2 12/2011 Fry

FOREIGN PATENT DOCUMENTS

WO 2007/105964 A1 9/2007

* cited by examiner

*Primary Examiner* — Tri Mai
(74) *Attorney, Agent, or Firm* — William W. Letson; Crystal Jones

(57) ABSTRACT

Embodiments of various stacking cartons that can be erected from a one-piece blank are provided. In this regard, a representative carton, among others, comprises a bottom wall, side walls and end walls. The side walls are foldably attached to left and right edges of the bottom wall. The end walls are foldably attached to top and bottom side edges of the bottom wall such that the side walls are located between the end walls. Each end wall is foldably attached to an end panel that is designed to fold and engage the inner surface of the end wall. The end wall is foldably attached to first reinforcing side panels at side edges of the end wall. Each first reinforcing side panel is foldably attached to a second reinforcing side panel that is designed to fold and engage the inner surface of the first reinforcing side panel.

12 Claims, 5 Drawing Sheets

STACKING CARTON USING A ONE-PIECE BLANK

CROSS REFERENCE TO RELATED APPLICATION

This application claims the benefit of U.S. Provisional Application No. 61/087,925, filed Aug. 11, 2008, which is entirely incorporated herein by reference.

TECHNICAL FIELD

The present disclosure generally relates to a stacking carton, and more particularly, a stacking carton that can be erected from a one-piece blank.

BACKGROUND

Currently in the industry, three blanks are typically used to erect a stacking carton that provides adequate stacking strength. Multiple folding machines are used to erect the blanks into the stacking carton, resulting in a complex procedure. Further, the three-piece stacking carton does not have continuous printable surface for graphics and texts. Thus, there is a need in the industry to provide a stacking carton that can be erected from a one-piece blank using a less complex procedure and provide printable surface, among others.

SUMMARY

Embodiments of various stacking cartons that can be erected from a one-piece blank are provided. In this regard, a representative carton, among others, comprises a bottom wall, side walls and end walls. The bottom wall has top, bottom, right, and left edges. The side walls are foldably attached to the left and right edges of the bottom wall. The side walls are positioned such that the side walls oppose each other.

The end walls are foldably attached to the top and bottom side edges of the bottom wall such that the side walls are located between the end walls. The end walls are positioned such that the end walls oppose each other. Each end wall is foldably attached to the bottom wall at the bottom edge of the end wall. Each end wall is foldably attached to an end panel at the top edge of the end wall. The end panel is designed to fold towards the bottom wall and engage the inner surface of the end wall.

The end wall is foldably attached to first reinforcing side panels at the side edges of the end wall. Each first reinforcing side panel extends parallel to the plane of the side walls. Each first reinforcing side panel is foldably attached to a second reinforcing side panel at the top edge of the first reinforcing side panel. The second reinforcing side panel is designed to fold towards the bottom wall and engage the inner surface of the first reinforcing side panel. The first and second reinforcing side panels have a width approximately half the width of the side walls.

Other cartons, methods, features, and advantages of the present invention will be or become apparent to one with skill in the art upon examination of the following drawings and detailed description. It is intended that all such additional cartons, methods, features, and advantages be included within this description, be within the scope of the present invention, and be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

Disclosed are stacking cartons that can be erected using a single corrugated blank. The cartons can contain products, such as, food/produce (such as fruits, vegetables, poultry, meat and fish). In general, the products are any items that can be packaged in the stacking carton.

Exemplary cartons are discussed with reference to the figures. Although the cartons are described in detail, the cartons are provided for purposes of illustration only and various modifications are feasible. The cartons shown in the figures have a cross-sectional shape of a square or rectangle; however, the cartons can have other cross-sectional shapes such as a circle, triangle, or other polygonal shapes.

Figure 1:
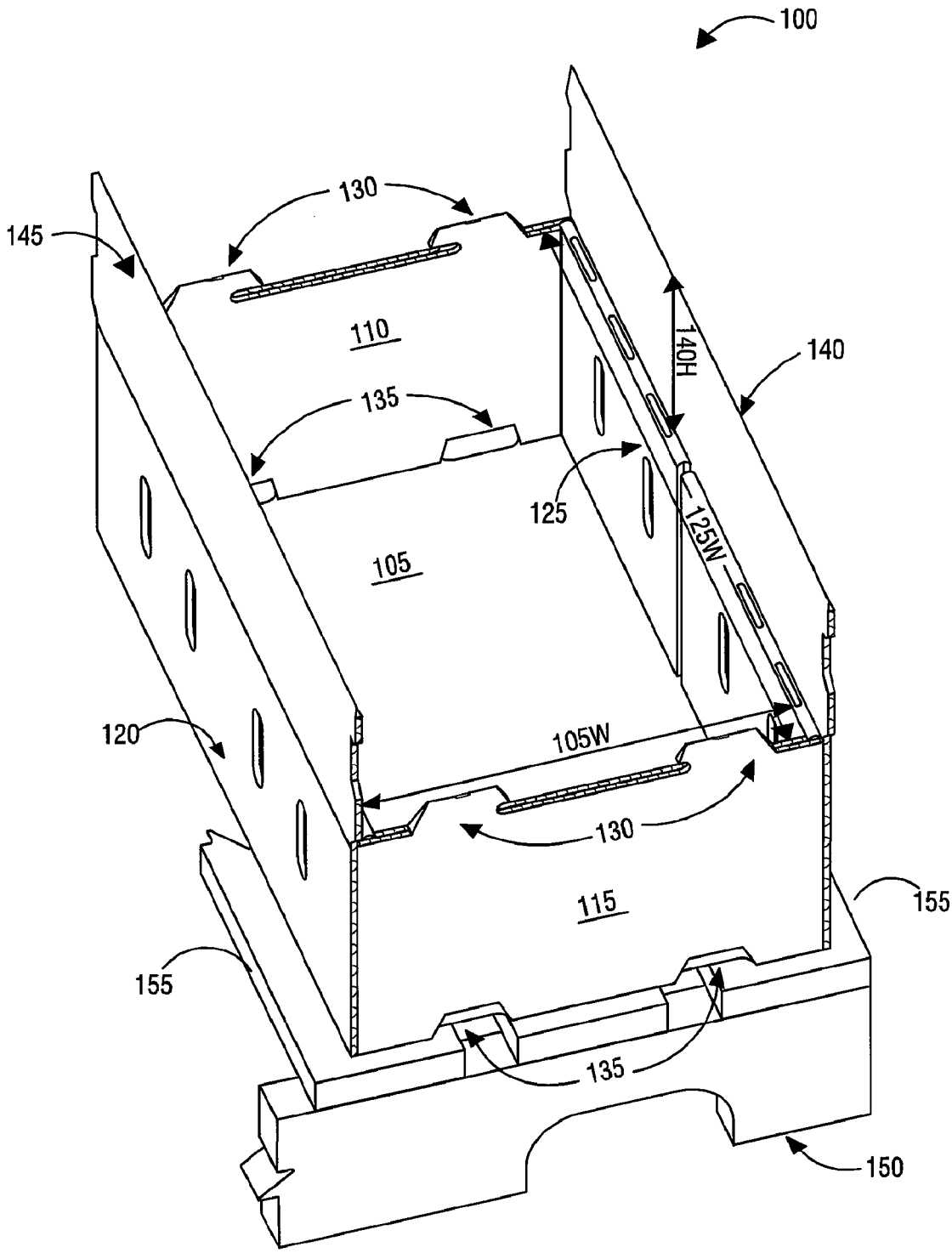
FIG. 1 is a perspective view of an embodiment of a stacking carton.

Referring now in more detail to the figures in which like reference numerals identify corresponding parts, FIG. 1 is a perspective view of an embodiment of a stacking carton 100. Such stacking carton 100 comprises a bottom wall 105, double-panel end members 110, 115, and triple-panel side members 120, 125. Each double-panel end member 110, 115 includes stacking tabs 130 and stacking slots 135 located at the top and bottom edges of the end members 110, 115, respectively. Each triple-panel side member 120, 125 is attached to a cover panel 140, 145 having a height 140H that is less than or equal to approximately half the width 105W of the bottom wall 105. The double-panel end members 110, 115 are positioned to oppose each other and the triple-panel side members 120, 125 are positioned to oppose each other. The strength of the triple-panel side member 120, 125 can be exploited to avoid collapse of the stacking carton by placing the triple-panel side member 120, 125 on top of pallet stringers 155.

Figure 2:
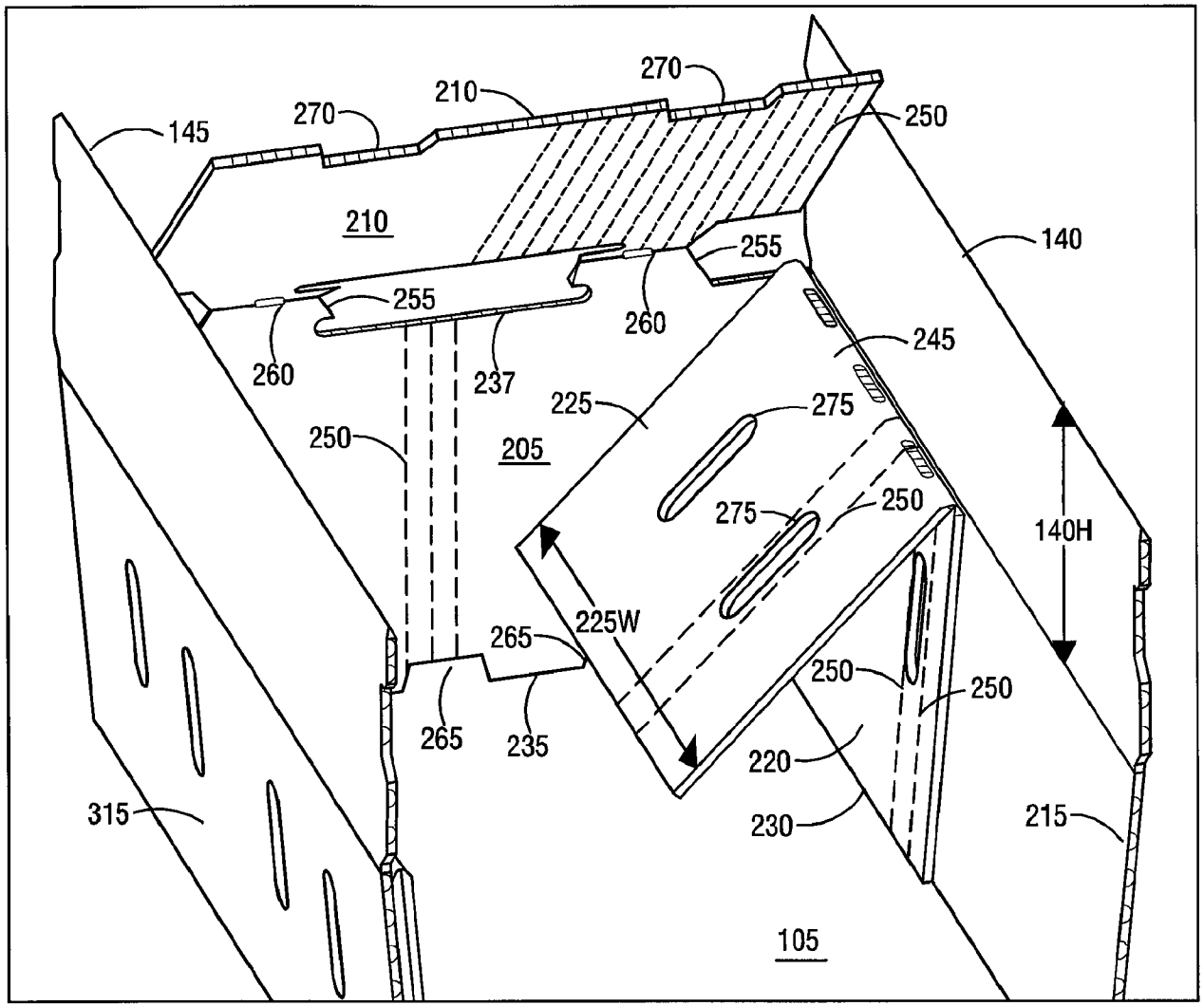
FIG. 2 is a perspective view of an embodiment of a partially preassembled stacking carton, such as that shown in FIG. 1.

FIG. 2 is a perspective view of an embodiment of a partially preassembled stacking carton 100, such as that shown in FIG. 1. The carton includes left side wall (not shown) and right side wall 215 that are foldably attached to the left edge (not shown) and right edge 230 of the bottom wall 105, respectively. The top and bottom edges of each end wall 205 include stacking tabs 255 and stacking slots 265, respectively. The end walls 205 are foldably attached to the bottom wall 105 at the top edge 235 and bottom edge (not shown) and at the bottom edges of the end walls 205. Each end wall 205 is foldably attached to an end panel 210 at the top edge 237 of the end wall 205.

In this example, the stacking tabs 255 of the end wall 205 is foldably attached to the end panel 210 that includes at least one stacking slot 270 and at least one stacking tab 260 on the top and bottom edges of the end panel 210, respectively. The end panel 210 is designed to fold towards the bottom wall 105 and engage the inner surface of the end wall 205. The end panel 210 has a configuration substantially similar to the end wall 205 such that the stacking tabs 255, 260 and stacking slots 265, 270 of the end wall 205 and the end panel 210 are aligned to form the stacking tabs 130 and stacking slot 135 shown in FIG. 1.

Each end wall 205 is foldably attached to first reinforcing side panels 220 at the left and right edges (not shown) of the end wall 205. Each first reinforcing side panel 220 extends parallel to the plane of the side walls 215. Each first reinforcing side panel 220 is foldably attached to a second reinforcing side panel 225 at the top edge 245 of the first reinforcing side panel 220. The second reinforcing side panel 225 is designed to fold towards the bottom wall 105 and engage the inner surface of the first reinforcing side panel 220. The first and second reinforcing side panels 220, 225 are generally in the shape of a rectangle and have a width 225W approximately half the width 125W of the side walls 215.

The second reinforcing side panel 225 has a configuration substantially similar to the first reinforcing side panel 220. The first and second reinforcing side panels 220, 225 include cut-out holes 275 that are aligned with the cut-out holes (not shown) of the side walls 215. The first and second reinforcing side panels 220, 225, the end panel 210, and the end walls 205 include vertical fluting 250 such that the vertical fluting 250 surrounds substantially the entire perimeter of the carton 100, enhancing stacking strength and increasing resistance to bulging.

Figure 3:
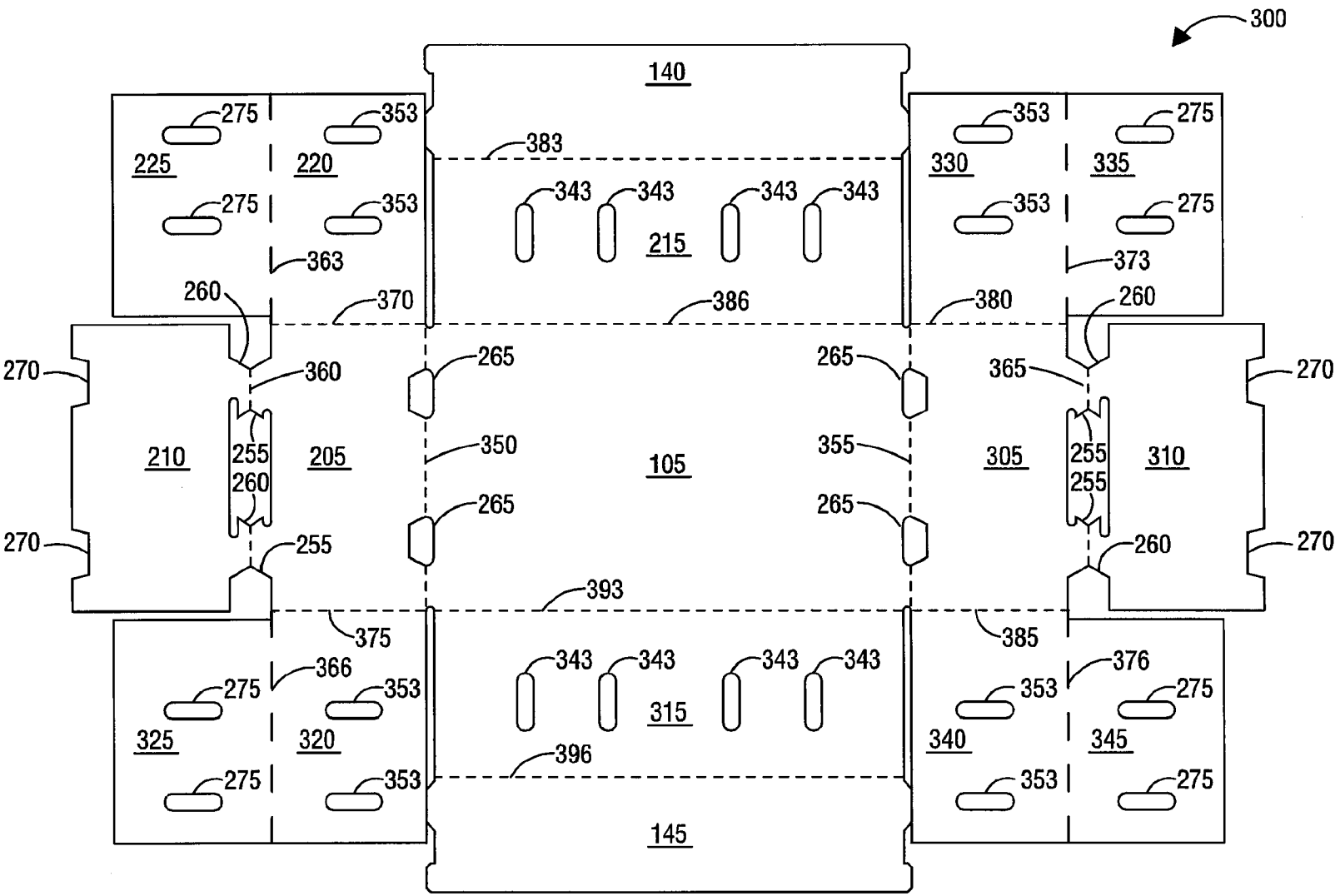
FIG. 3 is a plan view of an embodiment of a blank for erecting into the stacking carton, such as that shown in FIG. 1.

FIG. 3 is a plan view of an embodiment of a blank 300 for erecting into the stacking carton 100, such as that shown in FIG. 1. The blank 300 includes the bottom wall 105, first and second end walls 205, 305, and first and second side walls 215, 315. First end panel 210, first end wall 205, bottom wall 105, and second end wall 305 are connected along their right sides to the left sides of the first end wall 205, bottom wall 105, second end wall 305, and second end panel 310 along vertical fold lines 360, 350, 355, 365, respectively.

The left and right edges of the first end wall 205 include stacking tabs 255 and stacking slots 265, respectively, and the left and right edges of the second end wall 305 include stacking slots 265 and stacking tabs 255, respectively. The first and second end panels 210, 310 have a configuration substantially similar to the first and second end walls 205, 305, respectively. Top cover panel 140, first side wall 215, bottom wall 105, and second side wall 315 extend above the first side wall 215, bottom wall 105, second side wall 315, and bottom cover panel 145 and above horizontal fold lines 383, 386, 393, 396, respectively. The first and second side walls 215, 315 include cut-out holes 343.

Top left and top right first reinforcing side panels 220, 330 extend above the first and second end walls 205, 305 and above horizontal fold lines 370, 380, respectively. Bottom left and bottom right first reinforcing side panels 320, 340 extend below the first and second end walls 205, 305 and below horizontal fold lines 375, 385, respectively.

The top left and bottom left first reinforcing side panels 220, 320 are connected along their left sides to the right sides of the top left and bottom left second reinforcing side panels 225, 325 along vertical fold lines 363, 366, respectively. The top right and bottom right first reinforcing side panels 330, 340 are connected along their right sides to the left sides of the top right and bottom right second reinforcing side panels 335, 345 along vertical fold lines 373, 376, respectively. The first reinforcing side panels 220, 320, 330, 340 and second reinforcing side panels 225, 325, 335, 345 include cut-out holes 275, 353 that are aligned with the cut-out holes 343 of the side walls 215, 315 when the blank 300 is erected into the stacking carton 100.

All of the fold lines formed in blank 300 are formed by crushing the paperboard along the line to be folded to facilitate bending of the paperboard to form the various panels and flaps. Some perforations in the paperboard blank of this disclosure preferably are formed by scoring the paperboard so it is cut about 50% into the outer side of the paperboard material. This 50% cut is a continuous cut that extends from the surface of the material down to a depth that is about half of the thickness of the material. The 50% cut assures a clean tear at the surface that leaves a relatively pleasing appearance, particularly when the paperboard blank is printed.

To assemble the stacking carton 100, the blank 300 can be first folded along vertical fold lines 363, 366, 373, 376, 360, 365 such that the second reinforcing side panels 225, 325, 335, 345 and the end panels 210, 310 engage the inner surfaces of the first reinforcing side panels 220, 320, 330, 340 and the end walls 205, 305, respectively. The second reinforcing side panels 225, 325, 335, 345 and the end panels 210, 310 can be laminated and/or glued to the first reinforcing side panels 220, 320, 330, 340 and the end walls 205, 305, respectively.

The first and second end walls 205, 305 are folded 90 degrees along the vertical fold lines 350, 355 such that the first and second end walls 205, 305 are generally perpendicular to the bottom wall 105. The blank 300 can be folded along horizontal fold lines 370, 375, 380, 385 such that the first reinforcing side panels 220, 320, 330, 340 are generally perpendicular to and extend towards the first and second end walls 205, 305, respectively.

The first and second side walls 215, 315 are folded 90 degrees such that the first and second side walls 215, 315 are generally perpendicular to the bottom wall 105 and engage the outer surfaces of the first reinforcing side panels 220, 330, 320, 340, respectively. The first and second side walls 215, 315 the can be laminated and/or glued to first reinforcing side panels 220, 330, 320, 340, respectively. The top and bottom cover panels 140, 145 are folded 90 degrees such that the top and bottom cover panels 140, 145 extend parallel to the plane of the bottom wall 105.

The outer surfaces of the side walls 215, 315 and the end walls 205, 305 can be printed with graphics and texts. The cover panels 140, 145 limit moisture from entering into the corrugated walls of the end walls 205, 305, end panels 210, 310, first reinforcing side panels 220, 320, 330, 340, and second reinforcing side panels 225, 325, 335, 345.

Figure 4:
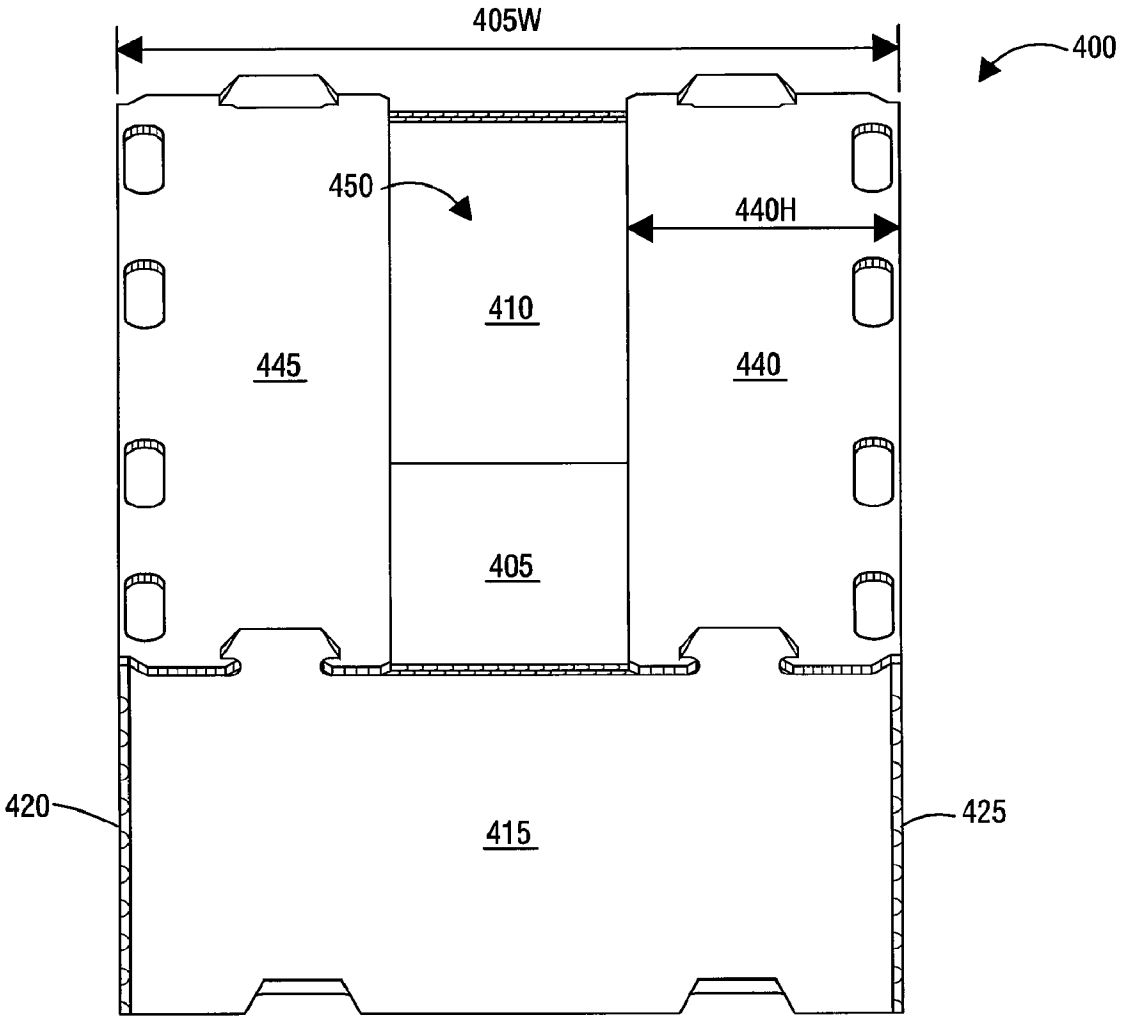
FIG. 4 is a perspective view of an embodiment of another stacking carton, such as that shown in FIG. 1.

FIG. 4 is a perspective view of an embodiment of another stacking carton, such as that shown in FIG. 1, and is denoted generally by reference number 400. The stacking carton 400 can be used for storing grapes and other fruits. In general, cartons that store and contain, e.g., grapes, are designed to allow certain amount of light exposure on the grapes by having openings 450 in the cartons, particularly on the top side of the cartons. The design and configuration of the stacking carton 400 is similar to the carton 100 shown in FIG. 1; thus, the stacking carton 400 includes the bottom wall 405, double-panel end members 410, 415, and triple-panel side members 420, 425. However, the stacking carton 400 includes cover panels 440, 445 that each has a height 440H that is less than or equal to approximately one-third of the width 405W of the bottom wall 405 to allow light exposure on the, e.g., grapes, at the opening 450.

Figure 5:
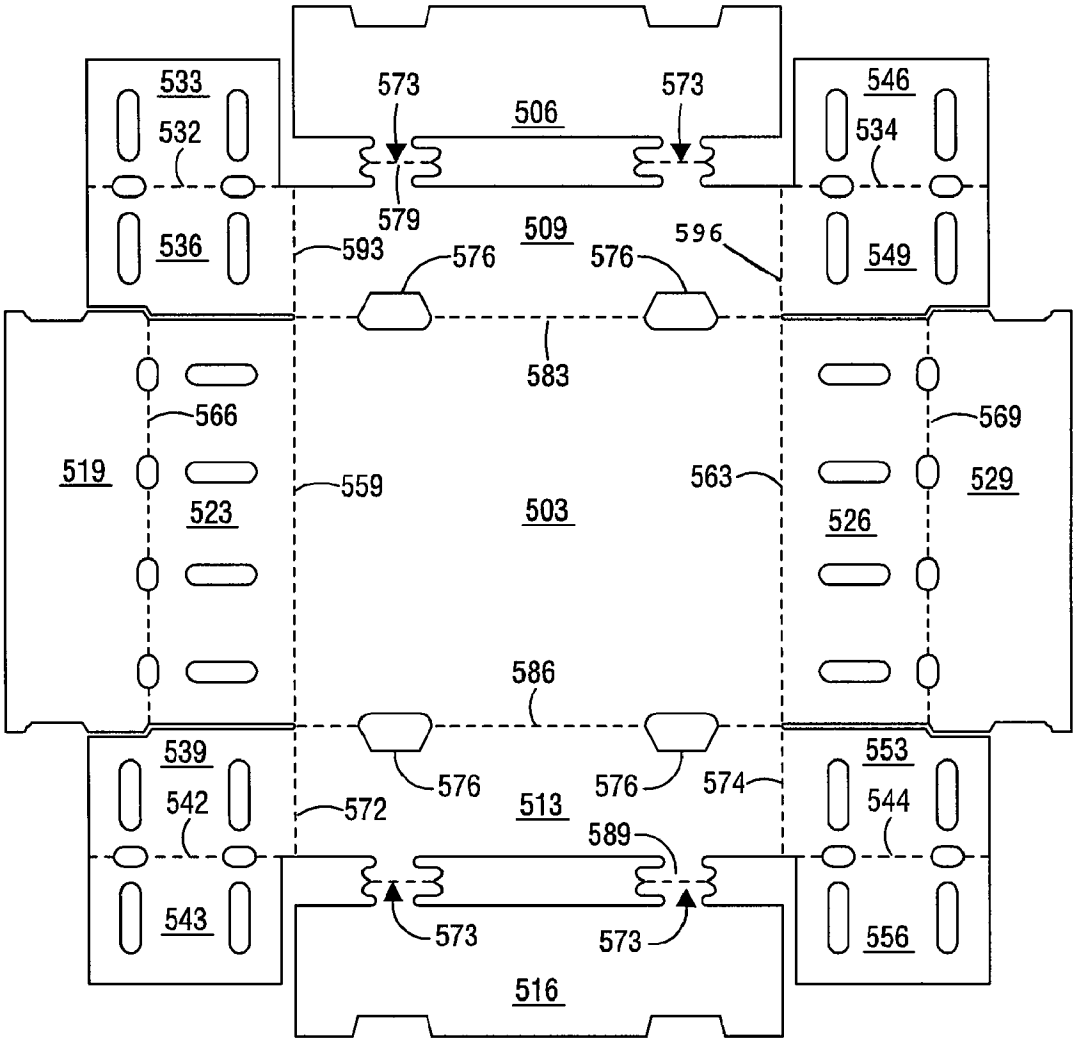
FIG. 5 is a plan view of another embodiment of a blank for erecting into a stacking carton, such as that shown in FIG. 1.

FIG. 5 is a plan view of an embodiment of a blank 500 for erecting into a stacking carton 100, such as that shown in FIG. 1. The blank 500 includes the bottom wall 503, first and second end walls 523, 526, and first and second side walls 509, 513. Left cover panel 519, first end wall 523, bottom wall 503, and second end wall 526 are connected along their right sides to the left sides of the first end wall 523, bottom wall 503, second end wall 526, and left cover panel 529 along vertical fold lines 566, 559, 563, 569, respectively.

The top and bottom edges of the first side wall 509 include stacking tabs 573 and stacking slots 576, respectively, and the top and bottom edges of the second side wall 513 include stacking slots 576 and stacking tabs 573, respectively. The first and second side panels 506, 516 have a configuration substantially similar to the first and second side walls 509, 513, respectively. First side panel 506, first side wall 509, bottom wall 503, and second side wall 513 extend above the first side wall 509, bottom wall 503, second side wall 513, and second side panel 516 and above horizontal fold lines 579, 583, 586, 589, respectively.

Top left and bottom left first reinforcing end panels 536, 539 are connected along their right sides to the left sides of the first side walls 509, 513 along vertical fold lines 593, 572, respectively. Top right and bottom right first reinforcing end panels 549, 553 are connected along their left sides to the right sides of the first side walls 509, 513 along vertical fold lines 596, 574, respectively.

Top left and top right second reinforcing end panels 533, 546 extend above the top left and top right first reinforcing end panels 536, 549 and above horizontal fold lines 532, 534, respectively. Bottom left and bottom right second reinforcing end panels 543, 556 extend below the bottom left and bottom right first reinforcing end panels 539, 553 and below horizontal fold lines 542, 544, respectively.

To assemble the stacking carton 100, the blank 500 can be first folded along vertical fold lines 532, 534, 542, 544, 579, 589 such that the second reinforcing end panels 533, 543, 546, 556 and the side panels 506, 516 engage the inner surfaces of the first reinforcing end panels 536, 539, 549, 553 and the side walls 509, 513, respectively. The second reinforcing end panels 533, 543, 546, 556 and the side panels 506, 516 can be laminated and/or glued to the first reinforcing end panels 536, 539, 549, 553 and the side walls 509, 513, respectively.

The first and second side walls 509, 513 are folded 90 degrees along the vertical fold lines 583, 586 such that the first and second side walls 509, 513 are generally perpendicular to the bottom wall 503. The blank 500 can be folded along horizontal fold lines 572, 574, 593, 596 such that the first reinforcing end panels 539, 553, 536, 549 are generally perpendicular to and extend towards the first and second side walls 509, 513, respectively.

The left and right end walls 523, 526 are folded 90 degrees such that the left and right end walls 523, 526 are generally perpendicular to the bottom wall 503 and engage the outer surfaces of the first reinforcing end panels 536, 539, 549, 553, respectively. The left and right end walls 523, 526 and the first reinforcing end panels 536, 539, 549, 553 can be laminated and/or glued together. The left and right cover panels 519, 529 are folded 90 degrees such that the left and right cover panels 519, 529 extend parallel to the plane of the bottom wall 503.

The outer surfaces of the side walls 509, 513 and the end walls 523, 526 can be printed with graphics and texts. The cover panels 519, 529 limit moisture from entering into the corrugated walls of the end walls 523, 526, side panels 506, 516, first reinforcing end panels 536, 539, 549, 553, and second reinforcing end panels 533, 543, 546, 556.

It should be emphasized that the above-described embodiments of the present invention, particularly, any "preferred" embodiments, are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

Therefore, having thus described the invention, at least the following is claimed:

1. A carton comprising:

a bottom wall having top, bottom, right, and left edges;

side walls that are foldably attached to the left and right edges of the bottom wall, the side walls being positioned such that the side walls oppose each other;

end walls that are foldably attached to the top and bottom side edges of the bottom wall such that the side walls are located between the end walls, the end walls being positioned such that the end walls oppose each other, each end wall being foldably attached to the bottom wall at the bottom edge of the end wall, the end wall being foldably attached to an end panel at the top edge of the end wall, the end panel being designed to fold towards the bottom wall and engage the inner surface of the end walls, the end panel having a configuration substantially similar to the end wall, the end panel having a substantially uniform width approximately equal to, but no broader than, a width of the end wall, the end wall and end panel being foldable onto each other at an end member fold line to form a double-panel end member, the end wall being foldably attached to first reinforcing side panels at the side edges of the end wall, each first reinforcing side panel extending parallel to the plane of the side walls, each first reinforcing side panel being foldably attached to a second reinforcing side panel at a reinforcing panel fold line at the top edge of the first reinforcing side panel and engage the inner surface of the side wall, the second reinforcing side panel being designed to fold towards the bottom wall and engage the inner surface of the first reinforcing side panel, the first reinforcing side panels, the second reinforcing side panels, and the side walls being foldable onto respective ones of each other to form a triple-panel side member;

wherein the first reinforcing side panel has a first width, the second reinforcing side panel has a second width, the second width being approximately equal to, but no broader than, the first width such that each second reinforcing side panel is foldable onto the respective first reinforcing side panel without overlapping the fold line between the end wall and the first reinforcing side panel;

wherein each end wall includes at least one stacking slot located at the bottom edge of the end wall, wherein each end wall includes at least one stacking tab located at the top edge of the end wall, wherein the at least one stacking tab is foldably attached to the end panel that includes at least one stacking tab and at least one stacking slot on the top and bottom edges of the end panel, respectively, the at least one stacking tab of the end wall and the at least one stacking tab of the end panel are foldably attached to each other to form double-panel stacking tabs; and wherein prior to folding, the end member fold line and the reinforcing side panel fold line are parallel and non-collinear.

2. The carton as defined in claim, 1, wherein the first and second reinforcing side panels, the end panel, and the end walls include vertical fluting such that the vertical fluting is around the perimeter of the carton, enhancing stacking strength and increasing resistance to bulging.

3. The carton as defined in claim 1, wherein at least one side wall is attached to a cover panel, the cover panel having a height that is less than or equal to approximately half the width of the bottom wall.

4. The carton as defined in claim 1, wherein the second reinforcing side panel has a configuration substantially similar to the first reinforcing side panel.

5. The carton as defined in claim 1 wherein the side walls include cut-out holes.

6. The carton as defined in claim 5, wherein the first and second reinforcing side panels include cut-out holes that are aligned with the cut-out holes of the side walls.

7. A blank for erecting into a carton for use with stacking tabs, said blank comprising:

a bottom wall having top, bottom, right, and left edges;

side walls that are foldably attached to the top and bottom edges of the bottom wall, the side walls being positioned such that the side walls oppose each other;

end walls that are foldably attached to the left and right side edges of the bottom wall such that the side walls are located between the end walls, the end walls being positioned such that the end walls oppose each other, the end walls being foldably attached to an end panel at the left and right edges of the end walls, respectively, the end panel being designed to fold towards the end walls and engage the inner surface of the end walls, the end panel having a configuration substantially similar to the end wall, the end panel having a substantially uniform width approximately equal to, but no broader than, a width of the end wall, the end wall and end panel being foldable onto each other at an end member fold line to enable forming a double-panel end member, the end wall being foldably attached to first reinforcing side panels at the top and bottom edges of the end wall, each first reinforcing side panel being foldably attached to a second reinforcing side panel at a reinforcing panel fold line at the left and right edges of the respective first reinforcing side panels, the second reinforcing side panel being designed to fold towards the first reinforcing side panel and engage the inner surface of the first reinforcing side panel, the first reinforcing side panels, the second reinforcing side panels, and the side walls being foldable onto respective ones of each other to form a triple-panel side member wherein the first reinforcing side panel has a first width, the second reinforcing side panel has a second width, the second width being approximately equal to, but no broader than, the first width such that each second reinforcing side panel is foldable onto the respective first reinforcing side panel without overlapping the fold line between the end wall and the first reinforcing side panel;

wherein each end wall includes at least one stacking slot located at the right and left edges of the respective end wall, wherein each end wall includes at least one stacking tab located at the left and right edges of the respective end wall, wherein the at least one stacking tab is foldably attached to the end panel that includes at least one stacking tab and at least one stacking slot on the right and left edges of the respective end panel, the at least one stacking tab of the end wall and the at least one stacking tab of the end panel being foldably attached to each other to form double-panel stacking tabs; and wherein the end member fold line and the reinforcing side panel fold line are parallel and non-collinear.

8. The blank as defined in claim 7, wherein at least one side wall is attached to a cover panel, the cover panel having a height that is less than or equal to approximately half the width of the bottom wall.

9. A package comprising:

a product; and a carton that is designed to contain the product, the carton comprising:

a bottom wall having top, bottom, right, and left edges;

side walls that are foldably attached to the left and right edges of the bottom wall, the side walls being positioned such that the side walls oppose each other;

end walls that are foldably attached to the top and bottom side edges of the bottom wall such that the side walls are located between the end walls, the end walls being positioned such that the end walls oppose each other, each end wall being foldably attached to the bottom wall at the bottom edge of the end wall, the end wall being foldably attached to an end panel at the top edge of the end wall, the end panel being designed to fold towards the bottom wall and engage the inner surface of the end walls, the end panel having a configuration substantially similar to the end wall, the end panel having a substantially uniform width approximately equal to, but no broader than, a width of the end wall, the end wall and the end panel being foldable onto each other at an end member fold line to form a double-panel end member, the end wall being foldably attached to first reinforcing side panels at the side edges of the end wall, each first reinforcing side panel extending parallel to the plane of the side walls, each first reinforcing side panel being foldably attached to a second reinforcing side panel at a reinforcing panel fold line at the top edge of the first reinforcing side panel and engage the inner surface of the side wall, the second reinforcing side panel being designed to fold towards the bottom wall and engage the inner surface of the first reinforcing side panel, the first reinforcing side panels, the second reinforcing side panels, and the side walls being foldable onto respective ones of each other to form a triple-panel side member;

wherein the first reinforcing side panel has a first width, the second reinforcing side panel has a second width, the second width being approximately equal to, but no broader than, the first width such that each second reinforcing side panel is foldable onto the respective first reinforcing side panel without overlapping the fold line between the end wall and the first reinforcing side panel;

wherein each end wall includes at least one stacking slot located at the bottom edge of the end wall, wherein each end wall includes at least one stacking tab located at the top edge of the end wall, wherein the at least one stacking tab is foldably attached to the end panel that includes at least one stacking tab and at least one stacking slot on the top and bottom edges of the end panel, respectively, the at least one stacking tab of the end wall and the at least one stacking tab of the end panel are foldably attached to each other to form double-panel stacking tabs; and wherein prior to folding, the end member fold line and the reinforcing side panel fold line are parallel and non-collinear.

10. The package as defined in claim 9, wherein the first and second reinforcing side panels, the end panel, and the end walls include vertical fluting such that the vertical fluting is around the perimeter of the carton, enhancing stacking strength and increasing resistance to bulging.

11. The package as defined in claim 9, wherein at least one side wall is attached to a cover panel, the cover panel having a height that is less than or equal to approximately half the width of the bottom wall.

12. The package as defined in claim 9, wherein the side walls include cut-out holes, and the first and second reinforcing side panels include cut-out holes that are aligned with the cut-out holes of the side walls.

* * * * *